US006250501B1

(12) United States Patent
Spina et al.

(10) Patent No.: US 6,250,501 B1
(45) Date of Patent: Jun. 26, 2001

(54) METHOD OF STORING AND DISPENSING THIN, FLIMSY OBJECTS

(75) Inventors: John A. Spina, Hamlin; John DePoint, Jr., Palmyra; Marion T. Juskiewicz, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/429,868

(22) Filed: Oct. 29, 1999

(51) Int. Cl.[7] ..... B65G 59/00; B65H 3/08; B65H 1/08; B65H 1/00

(52) U.S. Cl. ..... 221/278; 221/279; 221/226; 221/312 A; 221/45

(58) Field of Search ..... 221/45, 312 A, 221/278, 279, 226, 33, 59

(56) References Cited

U.S. PATENT DOCUMENTS

| | | | | |
|---|---|---|---|---|
| 1,065,112 | * | 6/1913 | Clarke . | |
| 1,478,744 | * | 12/1923 | Jones . | |
| 2,069,266 | * | 2/1937 | Nicodemus . | |
| 3,029,499 | * | 4/1962 | Eddison et al. . | |
| 3,158,287 | * | 11/1964 | Wilmer . | |
| 3,858,382 | * | 1/1975 | Suominen | 53/385.1 |
| 3,890,011 | * | 6/1975 | Futer | 406/83 |
| 4,052,250 | * | 10/1977 | Potts | 156/556 |
| 4,142,863 | * | 3/1979 | Covington et al. | 221/279 |
| 4,148,395 | | 4/1979 | Syracuse et al. . | |
| 4,199,076 | * | 4/1980 | Brown | 221/45 |
| 4,346,817 | * | 8/1982 | Karcher | 221/312 R |
| 4,552,285 | * | 11/1985 | Luscher | 221/13 |
| 4,685,852 | * | 8/1987 | Rubin et al. . | |
| 4,709,627 | * | 12/1987 | Staszko | 100/30 |
| 4,741,458 | * | 5/1988 | Odorici | 221/221 |
| 5,133,171 | | 7/1992 | Chase et al. . | |
| 5,442,828 | * | 8/1995 | Lutz | 15/88.3 |
| 5,445,078 | * | 8/1995 | Marion | 102/505 |
| 5,458,232 | * | 10/1995 | Novak et al. | 312/306 |
| 5,515,970 | | 5/1996 | Ritchie et al. . | |
| 5,536,472 | * | 7/1996 | Terashima et al. | 422/63 |
| 5,819,982 | * | 10/1998 | Brown | 221/226 |
| 5,971,206 | * | 10/1999 | Manukyan | 221/232 |
| 6,076,583 | * | 6/2000 | Edwards | 156/539 |

* cited by examiner

*Primary Examiner*—Christopher P. Ellis
*Assistant Examiner*—Jeffrey A. Shapiro
(74) *Attorney, Agent, or Firm*—Clyde E. Bailey, Sr.

(57) ABSTRACT

A method for storing and dispensing thin, flimsy objects such as end disks that form the ends of light-tight packages for photosensitive materials. The thin, flimsy objects are loaded onto a hub member and supported by a biased pusher plate that urges the objects one at a time through a stripper plate that has a removed section slightly smaller in dimensions than the object.

2 Claims, 5 Drawing Sheets

METHOD OF STORING AND DISPENSING THIN, FLIMSY OBJECTS

CROSS-REFERENCE TO RELATED APPLICATIONS

The present application is related to U.S. application Ser. No. 09/430,449, filed Oct. 29, 1999, by John A. Spina, et al., and entitled, "An Article Of Manufacture For Storing And Dispensing An Object;" and U.S. application Ser. No. 09/430,582, filed Oct. 29, 1999, by John A. Spina, et al., and entitled, "Cassette And Method For Storing And Dispensing Objects Arranged In A Stack."

FIELD OF THE INVENTION

The invention relates generally to a method of storing and dispensing thin, flimsy objects. More particular, the invention relates to a method of storing and dispensing objects such as end disks suitable for forming the ends of light-tight packages.

BACKGROUND OF THE INVENTION

Currently rolls of photographic film and paper are packaged in several different ways to facilitate room light loading into cooperating apparatus which dispenses or otherwise uses the film or paper. Commonly assigned U.S. Pat. Nos. 4,148,395 (Apr. 10, 1979, by Syracuse et al., and entitled "Roll Package") and 5,515,970 (May 14, 1996, by Ritchie et al., and entitled "Light-Tight Package") each discloses a package which includes a pair of flexible opaque end disks or covers attached to the ends of the core of the roll and an attached leader attached to the leading end of the length of film or paper forming the roll. A peripheral portion of each disk is folded over and adhered to the edge of an underlying convolution of the leader.

Commonly assigned U.S. Pat. No. 5,133,171 (Jul. 28, 1992, by Chase et al., and entitled "Light-Tight Packaging Method For Photosensitive Web Roll") discloses a package that includes a pair of similar end disks and a leader. After a first convolution of the leader is wrapped onto the roll, peripheral portions of the end disks are folded over the first convolution. A second convolution is then wrapped onto the roll to capture the folded-over peripheral portions between the first and second convolutions and to make the package light-tight.

An existing practice for installing end disks on light-tight packages of the sort described above include manually grasping an end disk from a stack and then fastening it to the ends of the core. Another practice includes using a vacuum suction device to pick out a single end disk and then transfer it to the core of the roll. Each of the above practices, however, has numerous shortcomings that the present invention solves. In particular, an operator will invariable damage thin, flimsy, end disks when handling them manually. Moreover, multiple end disks are dispensed although only one is intended.

Although not particularly related to the problem encountered by the inventors, U.S. Pat. No. 4,199,076 (Apr. 22, 1980, by Brown and entitled, "Cup Dispenser") discloses a dispenser of cups that has a slidable plate for supporting a stack of cups and an end plate having a cavity through which the cups are dispensed one at a time. The patent does not provide means for storing and dispensing thin, substantially flat objects.

Therefore a need persists in the art for a method of storing and dispensing thin flimsy objects that is simple to use, protects the fragile objects from damage and is cost effective to manufacture.

SUMMARY OF THE INVENTION

It is, therefore, an object of the invention to provide a method for storing and dispensing a plurality of thin flimsy objects.

It is another object of the invention to provide a method for storing and dispensing thin flimsy objects that can dispense a single object without affecting the next adjacent object in the stack.

The present invention is directed to overcoming one or more of the problems set forth above. Briefly summarized, according to one aspect of the present invention, a method of storing and dispensing thin, flimsy objects each having a first, removed concentric section, a loading side and an opposed active side, said method comprising the steps of:

providing a cassette having a base member, a hub member arranged centrally in the base member, a pusher plate arranged on said cassette for supporting a portion of one of said thin flimsy objects arranged in a stack, a stripper plate having a removed section for relieving a top most thin flimsy object from said cassette, and a source of air for separating said top most thin flimsy object from a nearest adjacent thin flimsy object;

mounting said thin flimsy objects onto said hub member with the loading side of one object in contact with he unloading side of the nearest adjacent object arranged in the stack; and, directing a burst of air to said loading side of said top most object and to the unloading side of said nearest adjacent object for relieving said top most object from said hub and then through said removed section of said stripper plate.

The advantages of the method of present invention include it's simplicity, ease of removing a object, elimination of damage to features of the thin flimsy object upon removal, such as interior diameter, and it is easily adaptable to various materials.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
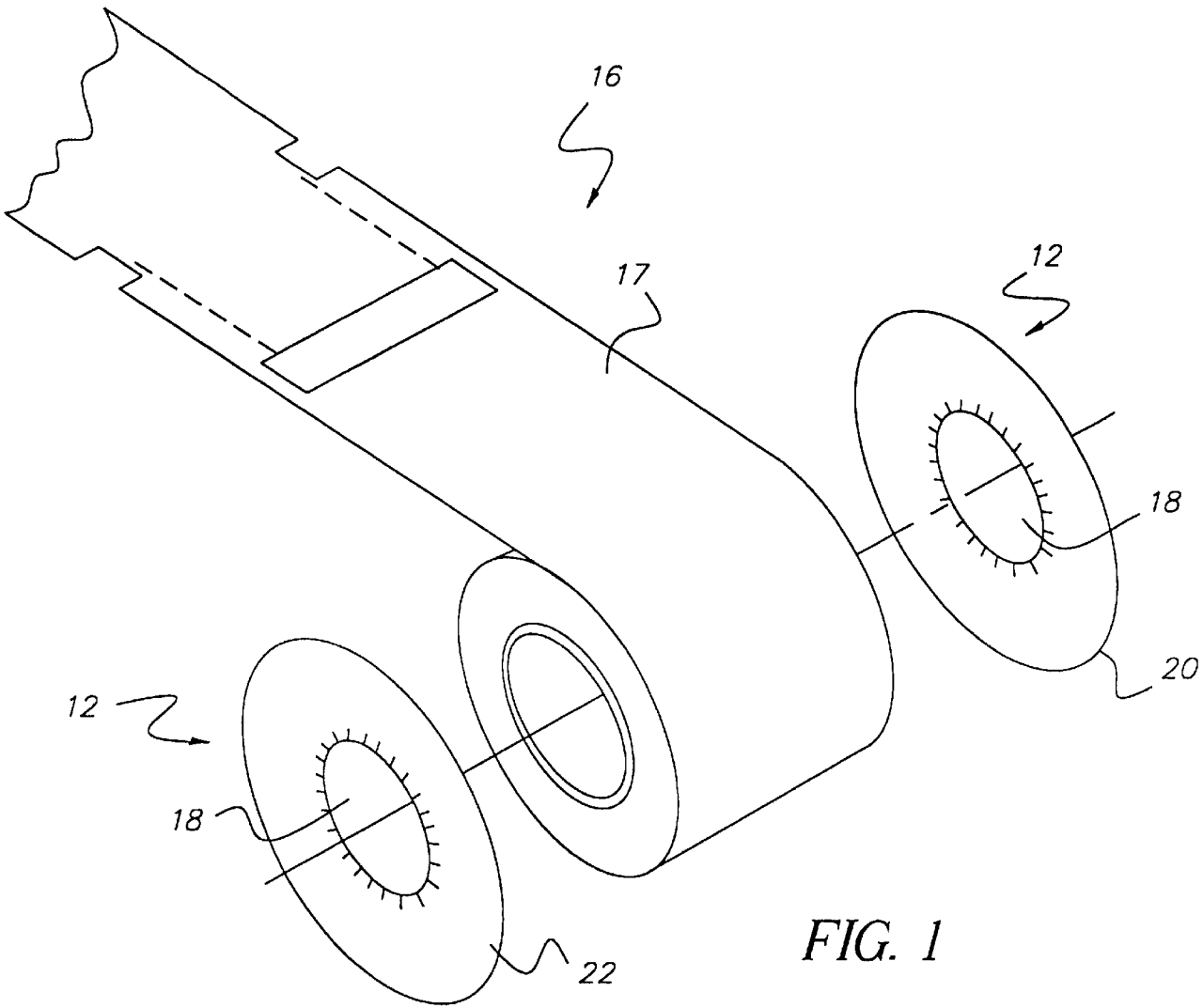
FIG. 1 is a schematic perspective, exploded view of a light-tight package having two unattached end disks.

The invention will now be described with respect to various embodiments thereof. Turning now to the drawings, and in particular to FIGS. 2–5, a storage and dispensing cassette 10 for objects, such as end disks 12 (shown in FIG. 1), arranged in a stack 14 is illustrated. Cassette 10 is suitable for use to store and dispense various sizes of end disks 12 (described below). The end disks 12, generally arranged in a stack 14 in cassette 10, are positioned to be picked from the cassette 10 via vacuum source (not shown) or similar methods, indexed to the pick position, and then dispensed one at a time from the cassette 10. According to FIG. 1, the objects or end disks 12 are suitable for use in a light-tight package 16 (FIG. 1). When properly arranged on the core of the roll of light sensitive web 17, a pair of identical end disks 12 blocks light passage to the light sensitive web 17. As seen in FIG. 1, end disks 12 have a first concentric section 18, a loading side 20 and an opposed unloading side 22. Moreover, end disks 12 are of flat materials made of generally plastic, foil, and paper laminates or extrusions with thickness from 0.003 inches to 0.010 inches. The form of the end disk 12 is generally one of circular shape with a removed concentric section 18.

Figure 2:
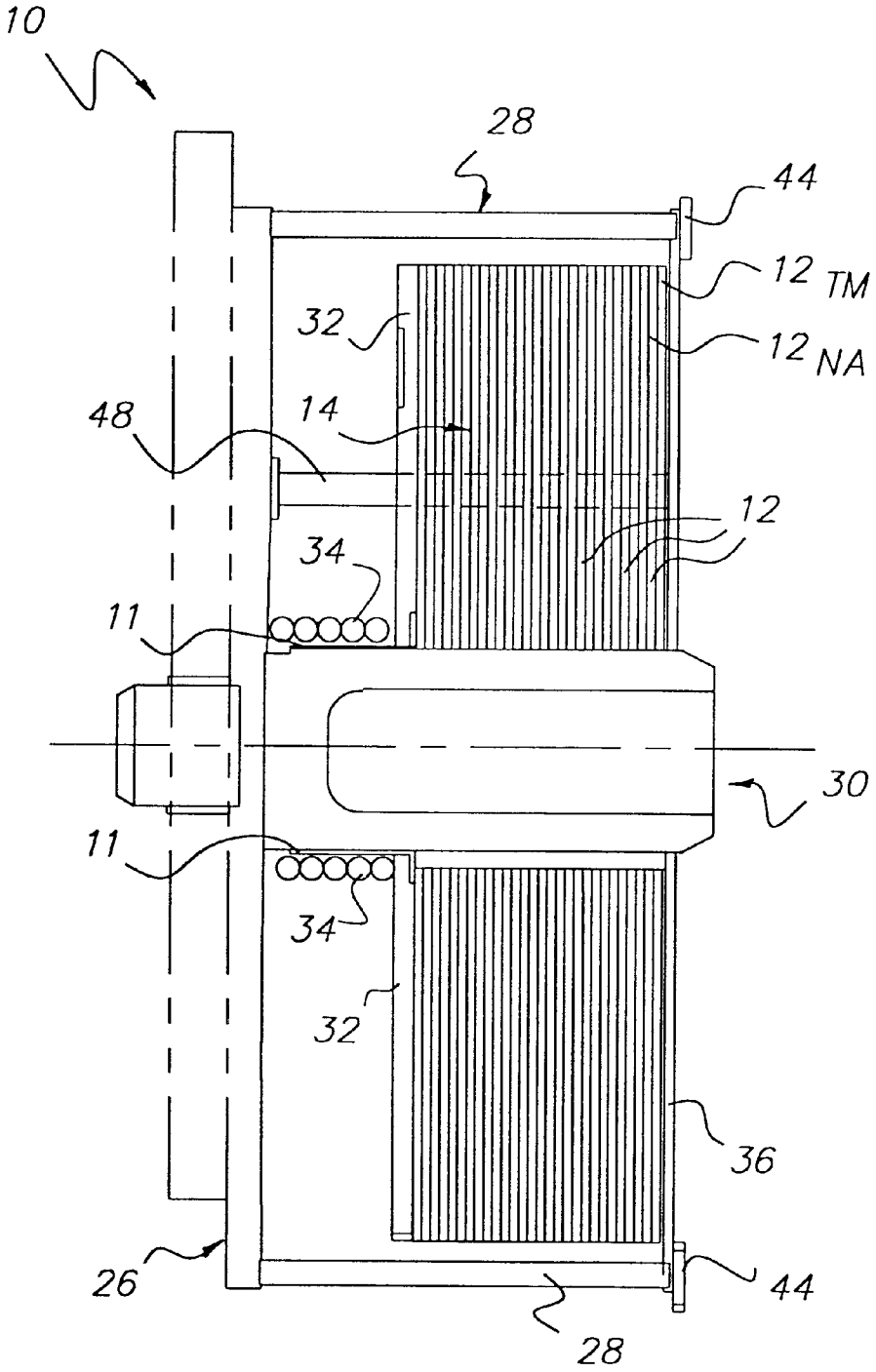
FIG. 2 is side elevation view, partially sectioned, of the cassette of the invention.

Referring to FIG. 2, cassette 10 has a body 24 (clearly shown in FIG. 4) having a base plate 26 and a plurality of spaced, upright, outwardly extending standoffs 28 fixedly attached at one end to the base plate 26.

Referring again to FIG. 2, a hub member 30 is arranged substantially centered in the base plate 26 and extends outwardly therefrom. The hub member 30 has a diameter slightly smaller than the first, removed concentric section 18 of any one of said plurality of objects or end disks 12 to be stored thereon.

As illustrated in FIGS. 2–5, a biased pusher plate 32 supports at least a portion of the loading side 20 (as shown in FIG. 1) of one of the plurality of objects or end disks 12 arranged about the hub member 30. The biased pusher plate 32 is biased preferably by spring 34 fixed against the base plate 26 and is slidable substantially in a plane substantially parallel to the base plate 26. The spring 34 is sized such that it is strong enough to push the stack 14 of end disks 12 as each is removed, but not too forceful to interfere with the removing of single end disks 12. With the material tested, a force between 1 lb. and 4 lbs. was acceptable. Other devices in place of springs could be used such as an air cylinder or a hydraulic cylinder which could apply constant force. Biased pusher plate 26 rides on bearings 11 and is slidable from a first position absent of supporting an object or end disk 12 thereon, to a second position supporting at least one of the objects or end disks mounted on the hub member 30. The outside diameter of the pusher plate 32 is preferably larger than the removed section 38 of the stripper plate 36 (described below), for it might push the last few end disks 12 through the second, removed concentric section 38 if it were smaller.

Figure 3:
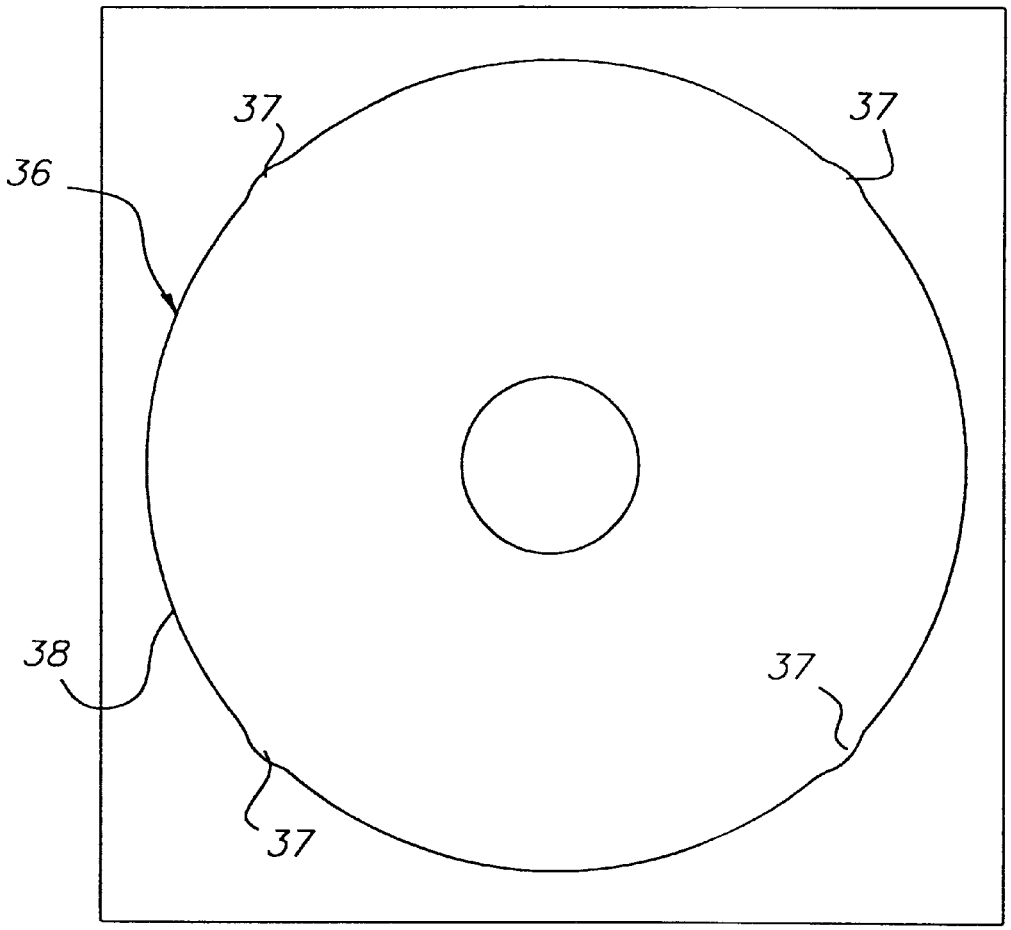
FIG. 3 is a front elevational view of the cassette of the invention.
Figure 4:
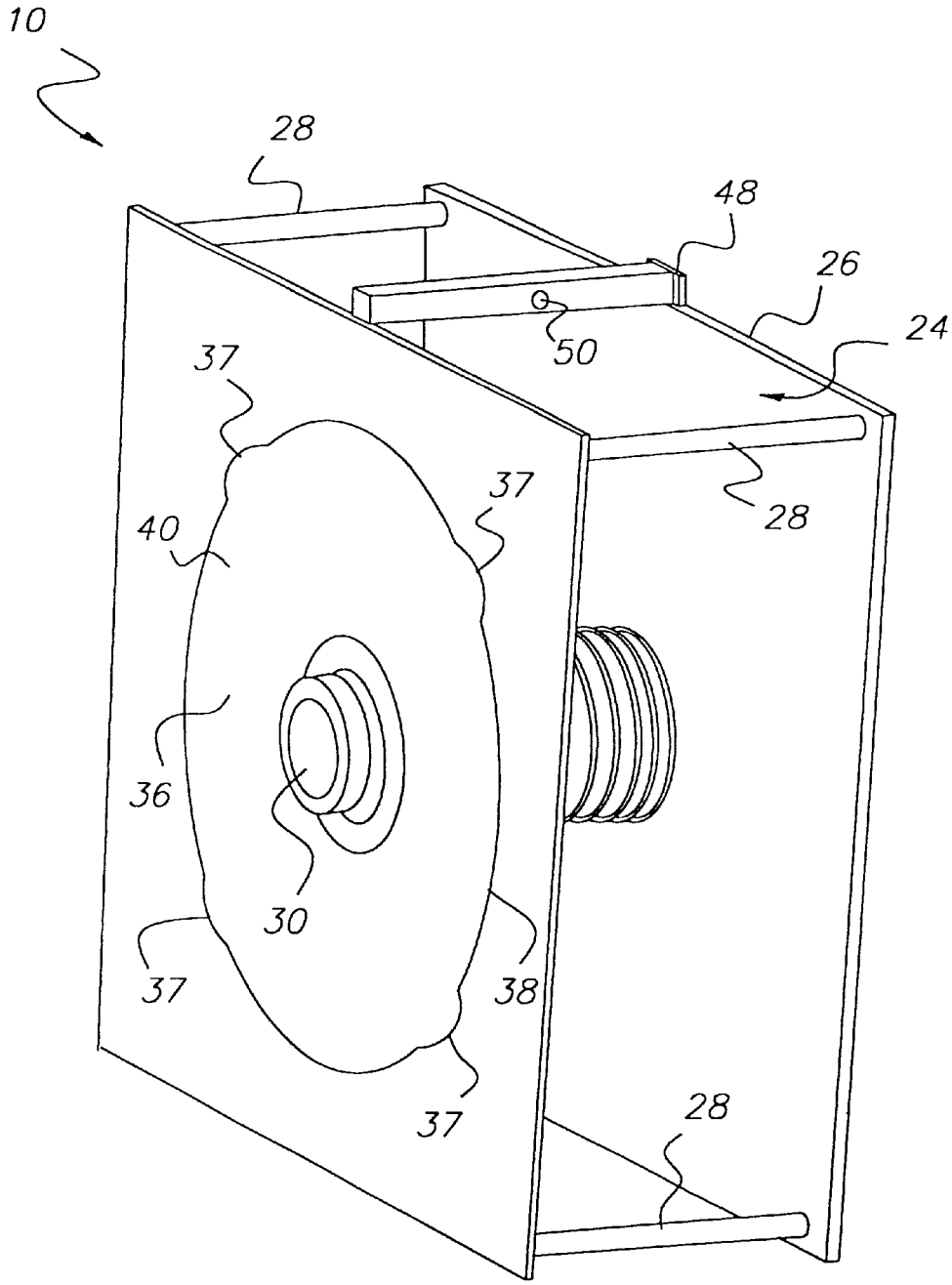
FIG. 4 is a perspective view, of the cassette tilted on a side.

Referring now to FIGS. 3 and 4, a stripper plate 36 has a removed section 38 and a continuous edge 40 surrounding the removed section 38. It is important to our invention that second concentric section 38 has a diameter at least slightly smaller than the diameter of the end disks 12 for securing a top most object or end disk $\mathbf{12}_t$ on the hub member 30. Clearly shown in FIG. 2, stripper plate 36 is supported on an end 44 of the outwardly extending standoffs 28 for receiving and relieving the end disks 12 through the second concentric section 38.

As indicated above, the removed section 38 of stripper plate 36 has a diameter smaller than the diameter of the removed concentric section 18 of end disks 12 so that the end disks 12 are retained but can be removed without permanently distorting the end disk material. As the air blast (described below) is applied, a smaller diameter of removed concentric section 38 in stripper plate 36 would be desired. Relief pockets 37 can be cut into the stripper plate 36 opening to allow the material to escape easier with less deformation also allowing the second, removed concentric section 38 of stripper plate 36 to be even smaller. To avoid forcing end disks 12 out the second, removed concentric section 38 from the force of the air blast (described below), the relief pockets 37 must not expose the outer surface (OD) of the end disk 12. The relief pockets 37 could be of various shapes, such as rectangular, square, triangular, and circular.

Figure 5:
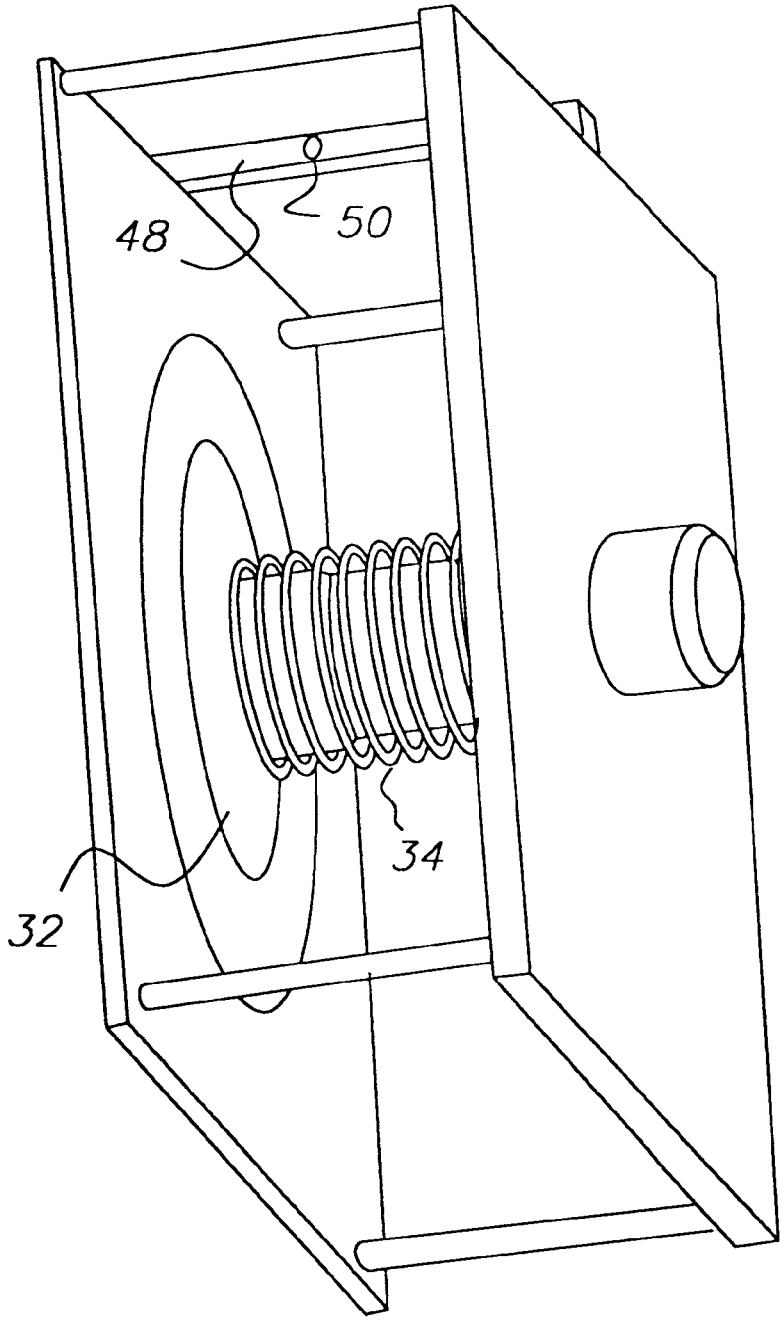
FIG. 5 is a perspective view of the cassette as shown in FIG. 4 tilted on an opposing side.

Referring to FIGS. 2, 4, and 5, a source of air 48 is structurally associated with the body 24 of cassette 10, for instance base plate 26. The source of air 48 has an air nozzle 50 directed between the loading side 20 of the top most end disk $\mathbf{12}_{TM}$ and the unloading side 22 of the nearest adjacent end disk $\mathbf{12}_{NA}$. A stream of air from air nozzle 50 causes the top most end disk $\mathbf{12}_{TM}$ to lift from the hub member 30 through the second concentric section 38 of the stripper plate 36. More particularly, the air nozzle 50 is positioned such that the air is directed in a manner to separate the leading (the end disk being dispensed) and the trailing disk, allowing the leading end disk to be removed without also removing or even partially removing the trailing end disk. The air nozzle 50 may be directed perpendicular to the stack 14 of end disks 12 as long as only one end disk 12 is removed. It also could be directed at some angle (i.e. 45 degrees) along the stripper plate 36 back face such that the air flow would travel along the stripper plate 36 face creating the desired state mentioned above. The position of the air nozzle 50 relative to the stack of end disks 12 should be in an area where air is allowed to pass between the two end disks 12, but not where the vacuum suction cups (not shown) are applying force. The end disks 12 must be able to move or separate relative to each other. The pressure of the air must be great enough to force the materials away from each other but not so great as to force the end disks 12 through the second, removed concentric section 38 of stripper plate 36. The setting would depend on material characteristics of the end disk 12 (i.e. flexibility). For instance, we tested an end disk 12 having a laminate structure comprising HDPE. It was determined that a pressure between about 30 psi and about 60 psi could be used to separate adjacent end disks 12 in a stack 14. Moreover, the amount of overlap of the removed section 38 of stripper plate 36 as well as the relief pockets 37 in the stripper plate 36 relative to the OD of the end disk 12 have some bearing on air pressure setting.

In operation, the end disks 12 are loaded onto the cylindrical end disk hub 30 about the removed concentric section 18 of the end disk 12. The end disks 12 are retained between the stripper plate 36 and the pusher plate 32 via pressure from pusher plate 32 spring 34. The pusher plate 32 and pusher plate bearing 11 index the end disks 12 to the pick position as each end disk 12 is removed. An air nozzle 50 supplies a blast of air that separates the ends as each end disk 12 is pulled through the stripper plate 36 and removed from the cassette 10. The air nozzle 50 is positioned such that it directs air in such a way to separate the leading and the lagging end disk 12. The removed section 38 in the stripper plate 36 is circular in shape and is slightly smaller in diameter than the end disk 12 outside diameter. The stripper plate 36 also has four relief pockets 37 to allow the end disk 12 to be pulled through without creasing the material as shown in FIG. 2.

When removing flexible materials it is desired to pick the material at three or four locations along the surface. A circular groove or ring (not shown) could also be used which would have 360 degrees of hold. It was found that pulling the material out of the removed section 38 of stripper plate

36 at a slight angle was beneficial as it peeled the material out versus pulling the entire surface out at once. This was accomplished using four vacuum suction cups (not shown), each one slightly more protruding than the next. As the end disk 12 is being pulled through the removed section 38 of stripper plate 36 it is desirable to move slowly until the end disk 12 is completely removed.

The invention has been described with reference to a preferred embodiment. However, it will be appreciated that variations and modifications can be effected by a person of ordinary skill in the art without departing from the scope of the invention.

PARTS LIST:

10 end disk dispensing cassette
11 pusher plate bearing
12 end disks
$\mathbf{12}_{TM}$ top most end disk
$\mathbf{12}_{NA}$ nearest adjacent end disk
14 stack of end disks 12
16 light-tight package
17 light sensitive web
18 removed concentric section of end disk 12
20 loading side of end disks 12
22 unloading side of end disks 12
24 body of cassette 10
26 base plate
28 standoff
30 hub member
32 biased pusher plate
34 spring
36 stripper plate
37 relief pockets
38 removed section of stripper plate 36
40 continuous edge
44 end of standoff
48 source of air
50 air nozzle

What is claimed is:

1. A method of storing and dispensing thin, flimsy objects each having a removed concentric section, a loading side and an unloading side, said method comprising the steps of:

providing a cassette having a base member, a hub member arranged centrally in the base member, a pusher plate arranged on said cassette for supporting a portion of one of said thin flimsy objects arranged in a stack, a stripper plate having a removed section for relieving a top most thin, flimsy object from said cassette, and a source of air for separating said top most thin, flimsy object from a nearest adjacent thin, flimsy object;

mounting said thin, flimsy objects onto said hub member with the loading side of one of said objects in contact with the unloading side of the nearest adjacent object arranged in said stack; and, directing a burst of air to said loading side of said top most object and to said unloading side of said nearest adjacent object for relieving said top most object from said hub member and then through said removed section of said stripper plate.

2. The method recited in claim 1 further comprising the step of pulling said thin, flimsy objects through said removed section of said stripper plate at a slight angle relative to said removed section.

* * * * *